US006923776B2

(12) United States Patent
Shabty et al.

(10) Patent No.: US 6,923,776 B2
(45) Date of Patent: Aug. 2, 2005

(54) COMPUTER-BASED CONTROL FOR A COUNTERPULSATION DEVICE USING NONCOMPRESSED AIR

(75) Inventors: Paul Shabty, Sarasota, FL (US); Willard D. Ferguson, Sr., Holmes Beach, FL (US); Willard D. Ferguson, Jr., Bradenton, FL (US); Timothy D. Smith, Palmetto, FL (US)

(73) Assignee: CPC America, Sarasota, FL (US)

( * ) Notice: Subject to any disclaimer, the term of this patent is extended or adjusted under 35 U.S.C. 154(b) by 429 days.

(21) Appl. No.: 10/242,529

(22) Filed: Sep. 12, 2002

(65) Prior Publication Data

US 2003/0050551 A1 Mar. 13, 2003

Related U.S. Application Data

(62) Division of application No. 09/136,158, filed on Aug. 18, 1998, now Pat. No. 6,450,981.
(60) Provisional application No. 60/055,976, filed on Aug. 18, 1997.

(51) Int. Cl.[7] ..... A61H 19/00
(52) U.S. Cl. ..... 601/150; 601/152
(58) Field of Search ..... 601/41, 44, 149, 601/150, 152

(56) References Cited

U.S. PATENT DOCUMENTS

| | | | | |
|---|---|---|---|---|
| 2,361,242 A | | 10/1944 | Rosett | |
| 3,654,919 A | | 4/1972 | Birtwell | |
| 3,859,989 A | | 1/1975 | Spielberg | |
| 3,866,604 A | | 2/1975 | Curless et al. | |
| 4,077,402 A | | 3/1978 | Benjamin, Jr. et al. | |
| 4,086,920 A | | 5/1978 | Miniere | |
| 4,197,837 A | | 4/1980 | Tringali et al. | |
| 4,753,226 A | | 6/1988 | Zheng et al. | |
| 4,986,260 A | | 1/1991 | Iams et al. | |
| 5,245,990 A | | 9/1993 | Bertinin | |
| 5,259,369 A | | 11/1993 | Matsumura et al. | |
| 5,394,892 A | * | 3/1995 | Kenny et al. | 128/897 |
| 5,443,440 A | | 8/1995 | Tumey et al. | |
| 5,513,956 A | | 5/1996 | Lewis et al. | |
| 5,554,103 A | | 9/1996 | Zheng et al. | |
| 5,575,762 A | | 11/1996 | Peeler et al. | |
| 5,830,164 A | * | 11/1998 | Cone et al. | 601/152 |
| 6,544,202 B2 | * | 4/2003 | McEwen et al. | 601/150 |

* cited by examiner

*Primary Examiner*—Danton D. DeMille
(74) *Attorney, Agent, or Firm*—Howard & Howard

(57) ABSTRACT

A counterpulsation device that operates without the use of compressed air or pressurized gas includes at least one inflatable cuff that is adapted to be placed about a selected portion of the patient's body. A first conduit connects the inflatable cuff to an air transfer device so that noncompressed air can be transferred from the air transfer device to the cuff through the first conduit to inflate the cuff. A second conduit connects the cuff to the air transfer device so that air can flow through the second conduit to deflate the cuff. The system is controlled using a computer-based controller that requires a series of initialization procedures before it will operate the system. A patient profile database includes historical treatment data for each patient and is automatically updated with each counter pulsation therapy session.

11 Claims, 8 Drawing Sheets

COMPUTER-BASED CONTROL FOR A COUNTERPULSATION DEVICE USING NONCOMPRESSED AIR

CROSS REFERENCE TO RELATED APPLICATIONS

This application is a division of U.S. Non-Provisional application Ser. No. 09/136,158, filed Aug. 18, 1998 now U.S. Pat. No. 6,450,981, which claims the benefit of U.S. Provisional Patent Application Ser. No. 60/055,976, filed Aug. 18, 1997.

BACKGROUND OF THE INVENTION

This invention generally relates to a counterpulsation device and more particularly to a counterpulsation device that operates without the use of compressed air.

Various counterpulsation devices are known and used in the medical field. Counterpulsation devices typically include inflatable cuffs that are placed about selected portions of a patient's body. The inflatable cuffs are typically placed about the calves, thighs and buttocks of a patient. The cuffs are inflated sequentially in a distal to proximal order during diastole. The inflation of the cuffs is timed to provide a second, pressurized pulse of blood flow to all organs above the buttocks cuff when the heart is normally resting between beats. The extra pulse of blood flow has been demonstrated to relieve angina pectoris, to raise cardiac output thereby improving the perfusion of organ beds and to enhance renal, cardiac and cerebral circulation.

In typical arrangements a compressed air source is used to inflate the cuffs and a vacuum pump is used to evacuate the cuffs as needed.

The currently available counterpulsation systems have several shortcomings and drawbacks, mainly because they require the use of compressed air. Compressed air is disadvantageous because it must be carefully managed or it introduces potential problems. Systems using compressed air can become overly pressurized because of a malfunction or blockage in the compressor or an associated accumulator. Overly high pressure conditions must be minimized to avoid subjecting the patient to excessive pressure when inflating the cuffs. Under extreme circumstances, excess pressure buildup introduces the possibility of having a portion of the system, such as a hose or the compressor housing, rupture unexpectedly.

Typical compressors also render conventional systems undesirably noisy, which makes them less than ideal for a hospital or clinic setting. The compressors and reservoirs are also relatively large and cumbersome, which decreases their ability to be readily relocated. The compressed air systems also require components such as vacuum pumps, which introduce additional cost, noise, complexity, and further maintenance issues.

Conventional systems require frequent maintenance because filters and other components must be replaced, especially in a counterpulsation application where the overall machine may be used continuously for many hours. Additionally, compressed air introduces the possibility of condensation build up within the system, which can interfere with proper valve, cuff, and other component operation to further exacerbate the maintenance issues.

All of the above drawbacks contribute to a major shortcoming of conventional systems, which is that they are not portable and useable in different clinical or hospital settings. Another drawback associated with some of the available systems is that they are not versatile enough to provide counterpulsation therapy for a wide enough variety of applications.

There is a need for a counterpulsation device that provides the capabilities of the pressure driven systems that are currently available while having the advantage of not including the use of pressurized or compressed gas. This invention overcomes the shortcomings and drawbacks discussed above and provides a system that is versatile in administering counterpulsation therapy without the use of pressurized or compressed air.

SUMMARY OF THE INVENTION

In general terms, this invention is computer-based method of operating and managing a counterpulsation device that most preferably operates without the use of compressed air or pressurized gas. The method of this invention includes several basic steps.

First, a series of procedures are defined that must be performed by an operator of the system. These procedures include, for example, identifying the patient and recording vital sign statistics such as heart rate and blood pressure. A computer associated with the system preferably prompts the operator through the series of procedures. The operator provides information to the computer to verify that each procedure is complete. The system controller will then enable the counterpulsation therapy device to be operated only after verifying that every defined procedure has been completed.

Another aspect of this invention is that the system includes a patient profile database. This database preferably includes historical treatment data for many individual patients. The system computer preferably automatically updates the database with each session.

The various features and advantages of this invention will become apparent to those skilled in the art from the following description of the currently preferred embodiment. The drawings that accompany the detailed description can be briefly described as follows.

DETAILED DESCRIPTION OF THE PREFERRED EMBODIMENT

Figure 1:
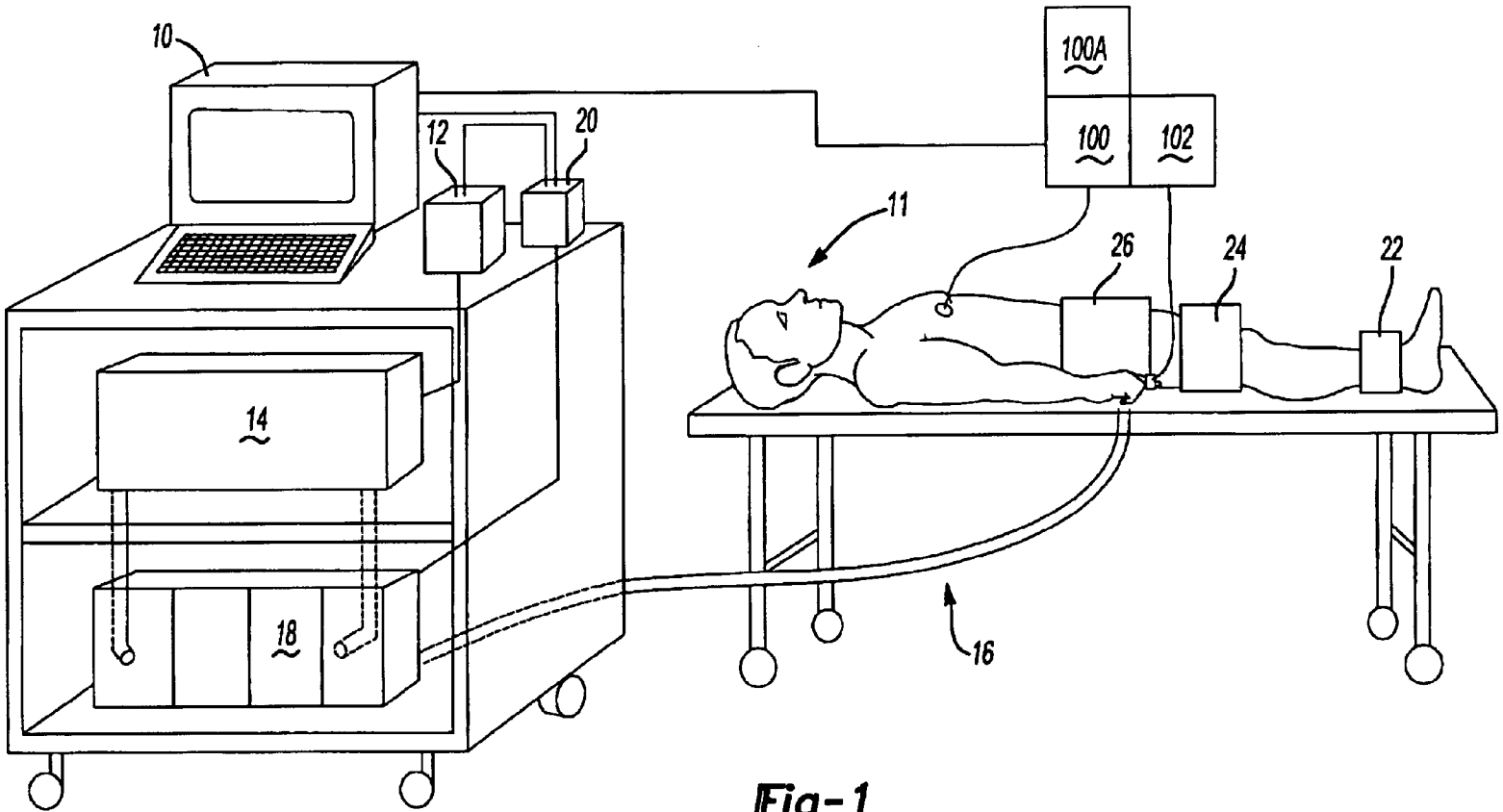
FIG. 1 is a diagrammatic illustration of a counterpulsation system designed according to this invention.

FIG. 1 diagrammatically illustrates, in simplified form, a counterpulsation system including a computer terminal 10 that enables a doctor or other health professional to operate the counterpulsation system to administer a desired therapy regimen to a patient 11. The computer 10 communicates with a controller 20 that communicates with a second controller 12, which controls the operation of an air moving device 14. A series of conduits 16 and valves 18 are controlled by the controller 20. A plurality of inflatable cuffs 22, 24 and 26 are inflated and deflated as the air moving device 14 moves air through the conduits 16 and valves 18 to the cuffs. Only one conduit 16 is shown in FIG. 1 for simplicity.

Figure 2:
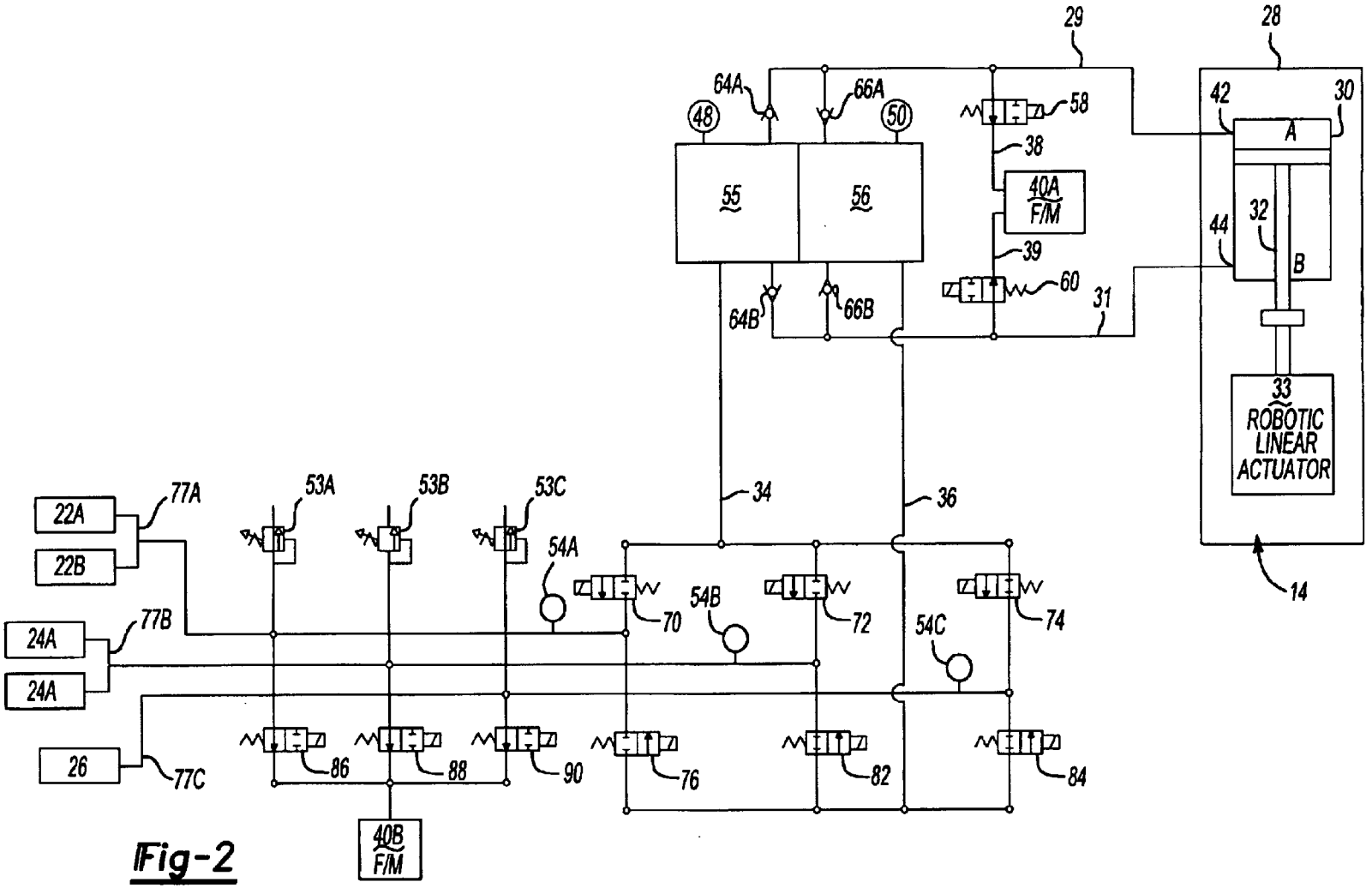
FIG. 2 is a more detailed schematic illustration of selected portions of a system designed according to this invention.

FIG. 2 schematically illustrates, in greater detail, selected portions of the counterpulsation system. The plurality of inflatable cuffs 22, 24 and 26 are adapted to be placed about the calves, thighs and buttocks of a patient, respectively. The inflatable cuffs are inflated in a sequence to enhance blood flow in a generally distal-to-proximal direction. The timing of the inflation of the cuffs is synchronized with portions of the EKG signal and plethysmographic wave of the patient to achieve the desire therapeutic effect, which can be varied depending upon the needs in a particular situation.

The preferred embodiment includes two cuffs 22A and 22B for the patient's calves, two cuffs 24A and 24B for the thighs and a single cuff 26 that is fitted about the buttocks. As the cuffs inflate, pressure against the body causes the desired additional pulse of blood flow. For simplicity, this specification refers to a "cuff" but that is to be understood to include a pair of cuffs. The preferred embodiment includes cuffs having a relatively rigid exterior with an inflatable portion inside facing the patient's skin.

The air moving device 14 is illustrated as an air transfer device 28 that preferably includes a cylinder 30 and a piston 32. A robotic linear servo actuator 33 moves the piston 32 within the cylinder 30 as dictated by the electronic controller 12, which communicates with the controller 20 that is programmed to achieve a desired counterpulsation therapy regimen. The air transfer device 28 most preferably utilizes noncompressed air, which is a significant departure from previous counterpulsation systems. Other noncompressed fluids may also be used depending on the criteria for a specific situation. Air is typically preferred because of its ready availability and the ability to discharge to atmosphere.

A first conduit 29 and a second conduit 31 connect the inflatable cuffs to the air transfer device 28 through a pressure transient suppressor 55, directional check valves 64A or 64B so that noncompressed air can be transferred through the third conduit 34 in a first direction to inflate the cuffs. Whether check valve 64A or 64B is used depends on the direction of travel of the piston 32 within the cylinder 30 as will become more apparent through this description. A fourth conduit 36 couples the cuffs to the air transfer device 28 through a vacuum transient suppressor 56 and directional check valves 66A or 66B so that air can flow in a second direction, caused by movement of the piston 32 within the cylinder 30, to deflate the cuffs. Again, which check valve operates depends on the direction that the piston 32 is moving. A fifth conduit 38 and a sixth conduit 39 connect the first conduit 29 and the second conduit 31, respectively, to the surrounding atmosphere through a noise filter 40A so that the air transfer device 28 can be vented to the atmosphere, recharging the cylinder 30 with air for subsequent stroking of the piston 32, or releasing excess air if necessary.

In the preferred embodiment, the cylinder 30 includes two ports 42 and 44. Solenoid valves 58 and 60 are placed within the pathway between the conduits 29 and 31 and the two conduits 38 and 39, respectively. The fifth conduit 38 and the sixth conduit 39 are directly coupled with the ports 42 and 44 through solenoid valves 58 and 60.

For controlling the amount of noncompressed air transferred to the cuffs, a pressure transmitter 48, is included to determine the amount of air pressure through the third conduit 34. Pressure gages 54A, 54B and 54C are also used to visually quantify instantaneous cuff pressure and inflation characteristics in the calf, thigh and buttock cuffs, respectively. When the pressure transmitter 48 indicates a pressure buildup to the cuffs, one of the solenoid valves 58 or 60 energize, depending on the direction of travel of the piston 32. The solenoid valves 58 and 60 are linked with the pressure transmitter 48 so that the valves 58 and 60 can be selectively opened to vent air through the conduits 38 or 39 and the noise filter 40A. That way, the air in the third conduit 34 never exceeds a preselected level. A further safety measure includes the addition of pressure relief valves 53A, 53B and 53C which mechanically prevent pressure buildup beyond the therapeutic set point in the calf, thigh and buttock cuffs respectively.

Similarly, the solenoid valves 58 and 60 are linked with a pressure transmitter 50. Whenever it is desirable to vent a vacuum within the first or second conduits 29 or 31 through the noise filter 40A, the transmitter 50 energizes solenoid valves 58 or 60, depending on the direction of travel of the piston 32. The solenoid valves 58 and 60 are linked with the pressure transmitter 50 so that the valves 58 and 60 can be selectively opened to reduce the vacuum level in conduits 29 or 31 through the noise filter 40A. That way, the vacuum in the fourth conduit 36 never exceeds a preselected level.

A series of solenoid valves 70, 72 and 74 are placed along the third conduit 34 to selectively supply air to the cuffs 22, 24 and 26, respectively.

A series of solenoid valves 76, 82 and 84 are placed along the fourth conduit 36 to selectively supply vacuum to the cuffs 22, 24 and 26, respectively. The phrase "supply vacuum" is synonymous with "venting" the cuffs.

A series of solenoid valves 86, 88, and 90 are placed along the calf, thigh and buttock supply conduits, which branch off of the conduit 34, to selectively vent the cuffs to atmosphere if desired. These valves preferably are normally closed valves. In the event of a power loss to the system, or if an electrical or electromechanical fault is detected by the controller 20, these valves open, venting the cuffs to atmosphere and removing all applied pressure from the patient.

The orientation of the various valves illustrated in FIG. 2 is suitable for inflating the cuff 22 by causing air to be transferred through the third conduit 34 upon movement of the piston 32.

In the preferred embodiment, the robotic linear actuator 33 moves in response to a command issued by the controller 20. The controller 20 communicates with the computer 10, which is linked with devices such as an electrocardiogram 100 (schematically shown in FIG. 1) and a plethysmograph 102. The preferred timing for moving the linear actuator 33 is arranged based upon a portion of the electrocardiogram signal and the peripheral plethysmographic wave. In particular, the linear actuator 33 moves the piston 32 one half stroke each time that the cuffs should be inflated, or in the event of increased demand for air volume, repeated half strokes.

When the suitably programmed computer 10 and controller 20 determine that it is time to inflate the cuffs, several steps are performed. The first step is to evacuate the cuffs of existing air. Secondly, the linear actuator 33 moves the piston 32 through the cylinder 30 one half stroke. One half stroke (according to the drawing) includes the piston 32 moving from a position indicated at B and upward (according to the drawing) to the position indicated at A. In other words, FIG. 2 illustrates the piston 32 having been moved one half of one stroke from the position indicated at B to the illustrated position, which corresponds to the full distance between the two furthest end positions of travel of the piston 32. When the linear actuator 33 moves the piston 32 one half stroke, the air movement within the cylinder 30 is transferred through the third conduit 34 directly to the inflatable cuffs.

Since the cuffs most preferably are inflated in a distal to proximal sequence, the cuff 22 is inflated first, followed by the cuff 24 and then followed by the cuff 26. Accordingly, the controller 20 sequences the opening of the valves 70, 72, and 74 in a timed pattern that corresponds to a desired therapeutic regimen. Since the cuffs are inflated during diastole, the pressure from the cuffs acts on the patient's body and circulatory system so that a second pulse of blood flow is provided to the portions of the body that are above the buttocks cuff 26.

The cuffs remain inflated for a preselected time, which corresponds to the counter pulsation system being in a hold pattern. The next heartbeat of the patient, and more specifically at the next appropriate portion of the EKG signal, the pattern of evacuating the cuffs and subsequently inflating them is repeated.

The cuffs are evacuated by opening the valves 76, 82 and 84 so that the air from within the cuffs is transferred through the fourth conduit 36 into the cylinder 30.

Each half stroke of the piston 32 preferably results in the cuffs being inflated. As the piston 32 moves from an initial position indicated at B through one half stroke to the position indicated at A, air is transferred through the port 42, the check valve 64A and the third conduit 34. This stroke also creates a vacuum behind the piston 32 as it moves through the cylinder 30 to be transferred through the port 44, the check valve 66B moves from the position indicated at A through a half stroke back to the position indicated at B, air is transferred through the port 44, the check valve 64B and the third conduit 34. This stroke also creates a vacuum behind the piston 32 as it moves through the cylinder 30 to be transferred through the port 42, the check valve 66 and the fourth conduit 36.

It is important to note that the system does not use compressed or pressurized air during the inflation or deflation of the cuffs. This represents a significant advantage over prior counterpulsation systems because compressed air requires a compressed air source or pump, at least one reservoir and a vacuum pump that can introduce the problems and difficulties discussed above.

Another significant advantage of this invention is that it provides a portable system that is versatile for many applications in different settings. For example, therapy administered with a system designed according to this invention enhances cardiac output and improves conditions characterized by deficient organ perfusion such as acute and chronic myocardial ischemia, acute and chronic renal insufficiency, acute and chronic cerebrovascular insufficiency and peripheral vascular disease. By making minor changes in operating parameters, the illustrated embodiment can be adapted for assisting hemostasis after invasive procedures and for treating lymphedema. The system of this invention provides an external, noninvasive, nontoxic and atraumatic technique.

Noncompressed or nonpressurized air or another fluid is, therefore, readily useable to achieve a desired counterpulsation therapy regimen. The inventive system includes an arrangement of valves like those illustrated in FIG. 2 to control the direction and amount of air flow through the system. Controlling the positions or energization of each of the valves as described above is accomplished by programming the computer 10 and the controller 20. Given this description, those skilled in the art will be able to select appropriate electronic components and software to achieve the operation described above and to meet the needs of a particular therapy regime. The particular timing and sequence of the inflation and deflation of the cuffs will vary according to the particular therapeutic needs of a particular situation.

Figure 3A:
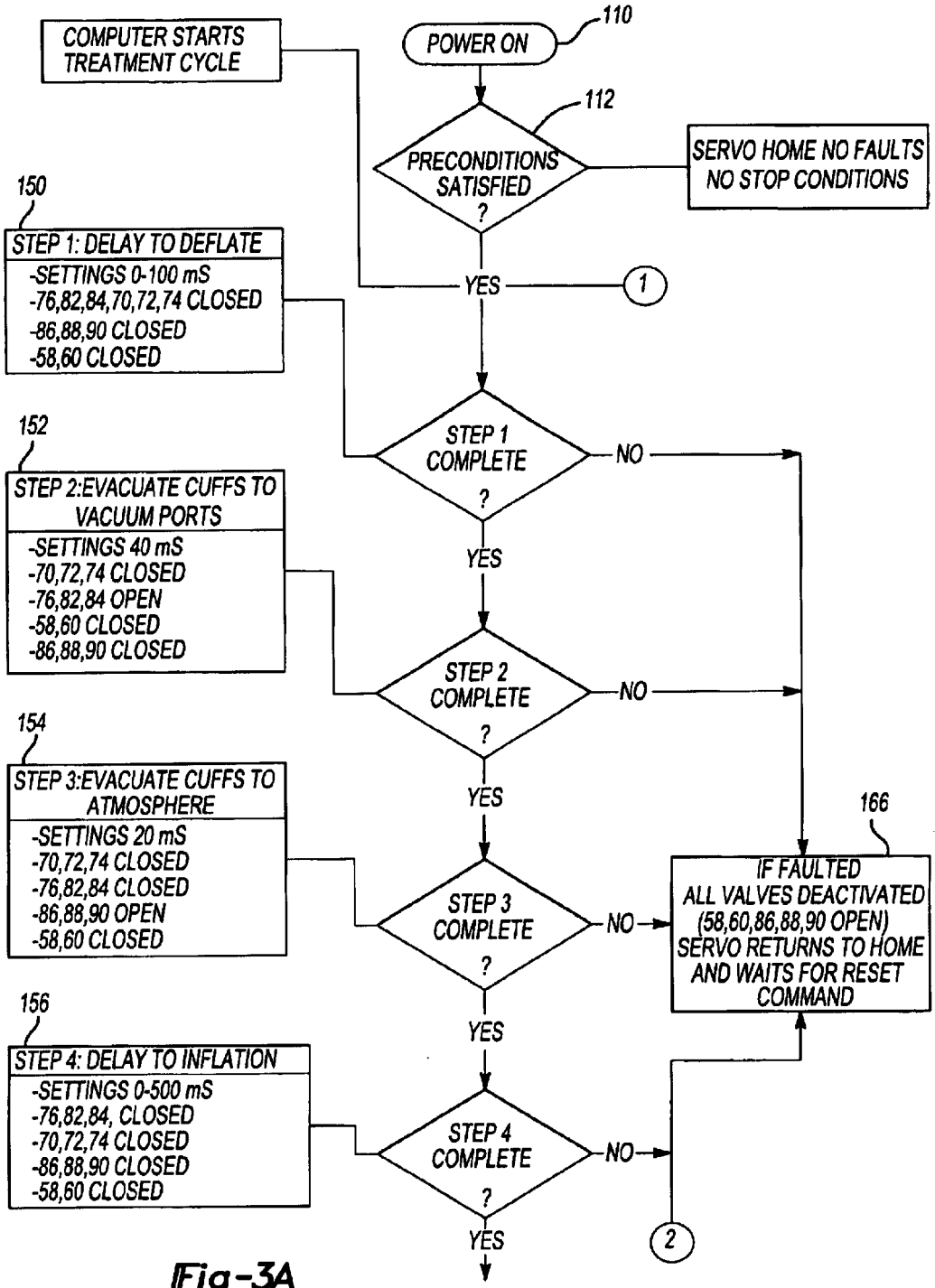
FIGS. 3A and 3B constitute is a flow chart diagram summarizing the method of operating a system designed according to this invention.
Figure 3B:
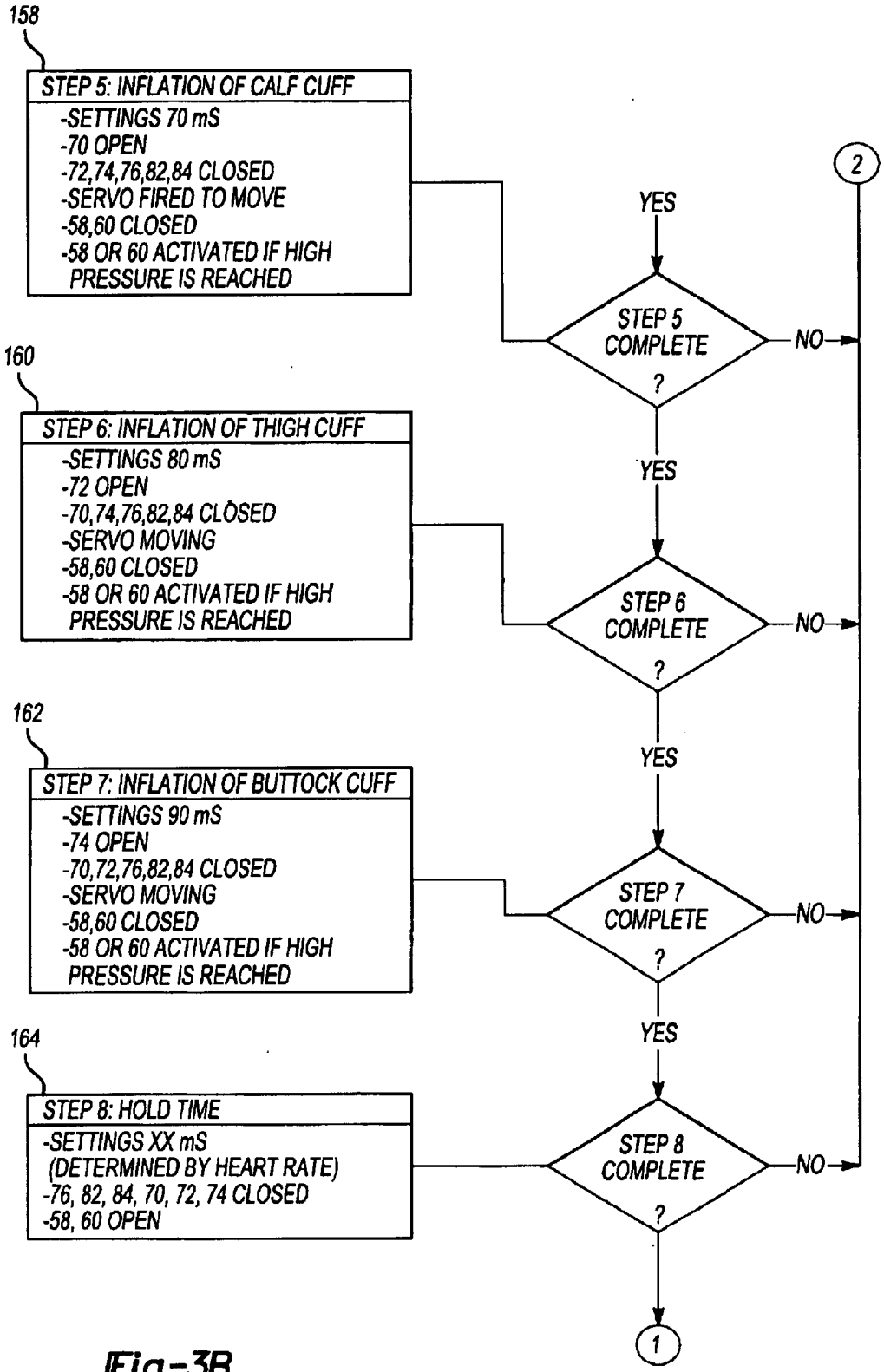

FIGS. 3A and 3B include a flow chart that summarizes the overall operating procedure of a counterpulsation system designed according to this invention. The preferred operation sequence will be described in more detail below.

The preferred embodiment includes a program module within the computer 10 that prompts the doctor or health professional through a series of steps or procedures to initiate the counterpulsation system. The computer preferably includes a display screen for displaying a series of messages and images that lead the technician through the initiation process. The display screen most preferably is a touch screen that allows interaction with the computer by contact with specific portions of the screen as prompts may indicate. Initializing the counterpulsation system preferably includes, but is not necessarily limited to, the following steps.

The operator of the counterpulsation therapy system preferably begins the session by turning on the computer 10 at 110 in FIG. 3A. At that point, the program module within the computer 10 begins prompting the operator through the series of procedures that need to be completed to initialize the system. As shown in FIG. 3A, the computer 10 will not begin the therapy session until the preconditions have been satisfied at 112.

Figure 4:
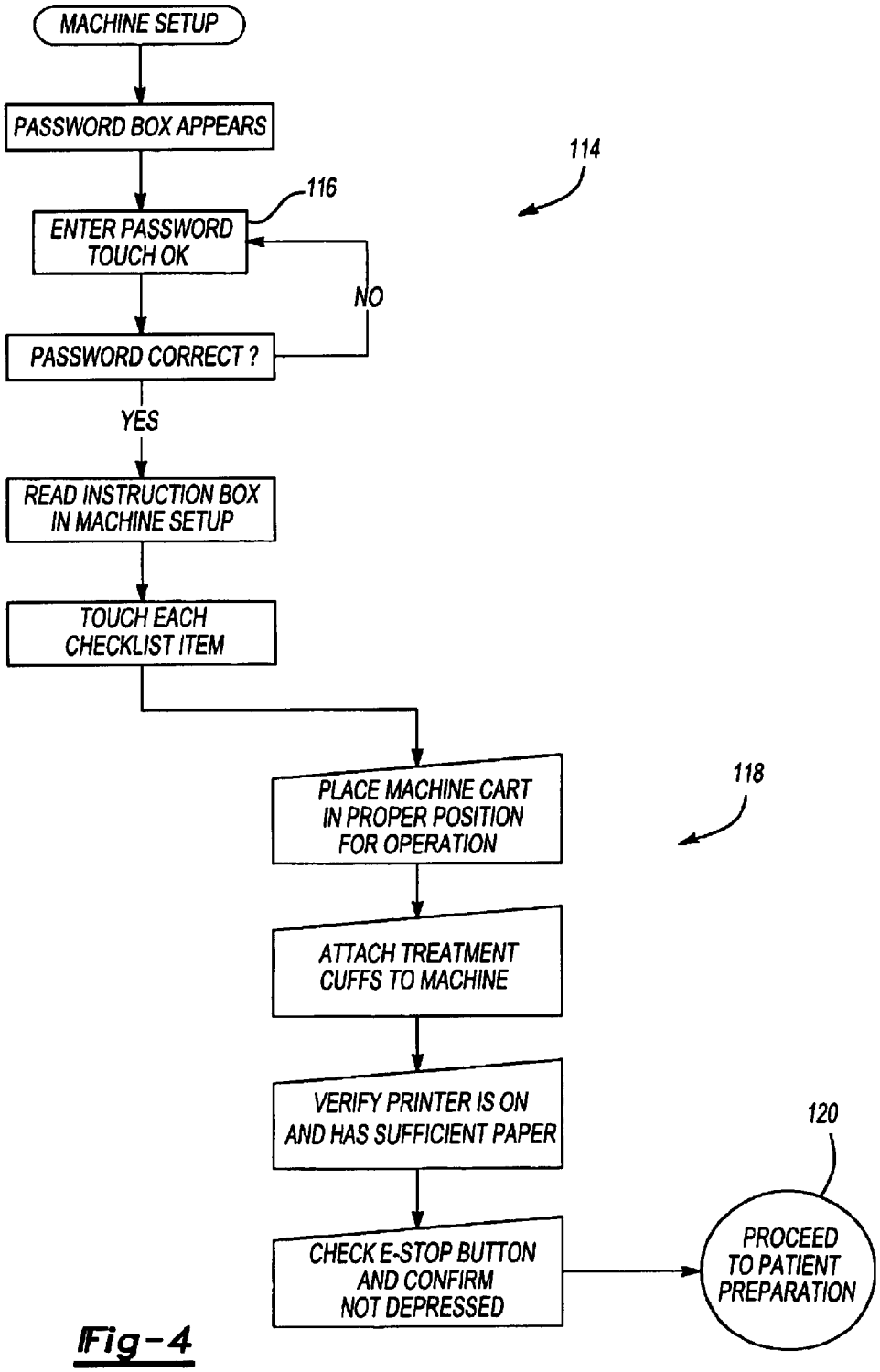
FIG. 4 is a flow chart diagram illustrating a portion of the procedures associated with using this invention.

Referring to FIG. 4, the first portion of the preconditions or procedures that need to be performed is illustrated at 114 in flow chart form. Initially at 116, the operator enters a password to allow access to the system. The computer 10 preferably is programmed to recognize selected passwords for controlling the number of individuals allowed to operate the system. After the password has been verified the operator then sets up the system at 118. The system preferably includes a cart as illustrated in FIG. 1 that facilitates easily moving the therapy system between patient rooms or other locations. A typical scenario would include moving the cart into a proper position, connecting the treatment cuffs 22, 24 and 26 to the appropriate portions of the machine, and setting up any peripheral devices such as a computer printer for providing a hard copy printout of information from the therapy session as desired.

Figure 5:
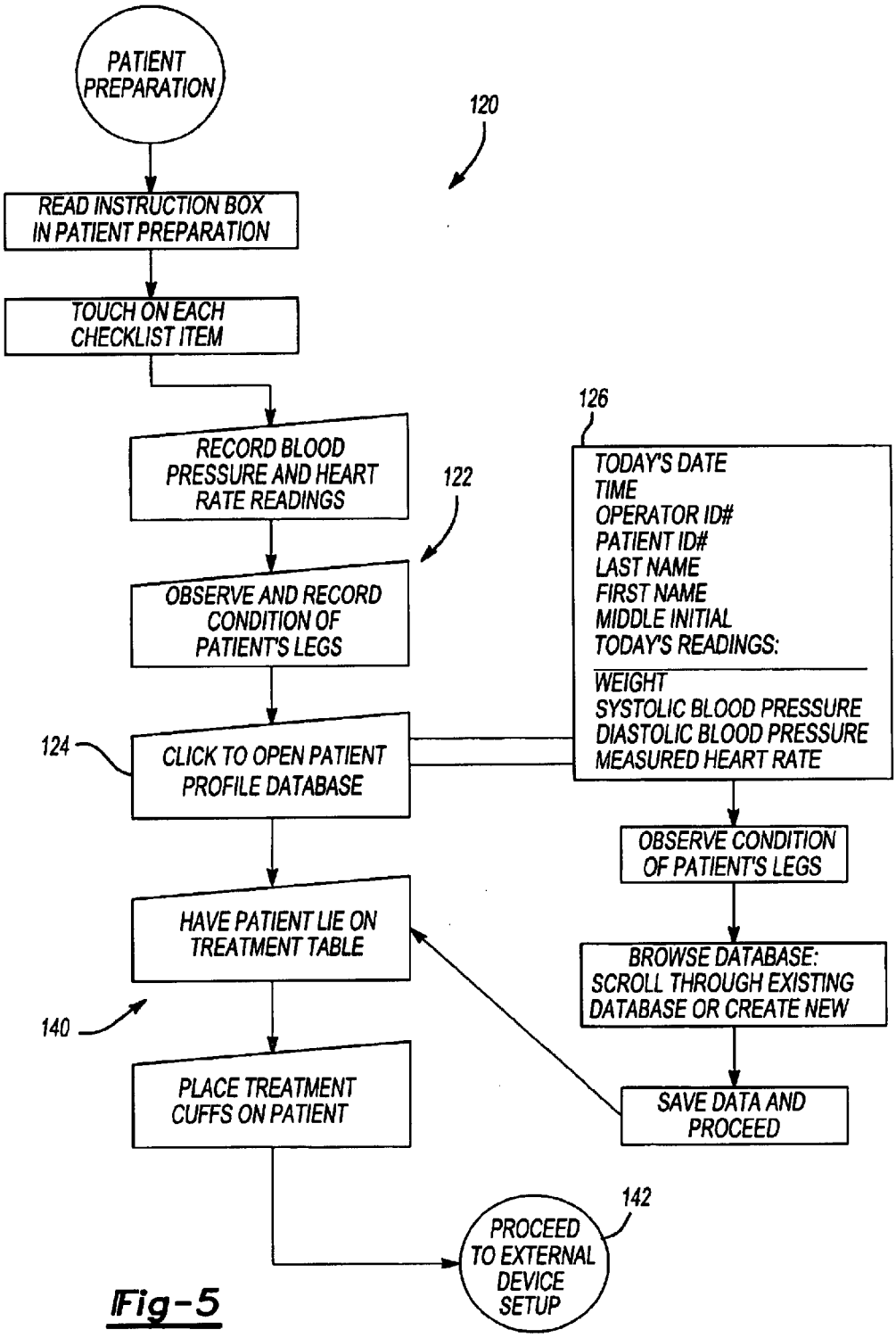
FIG. 5 is another flow chart diagram illustrating another portion of the method of this invention.

Once the machine is properly set up, the operator is then prompted by the computer 10 to proceed to preparing the patient for therapy at 120. As shown in flowchart form in FIG. 5, the operator preferably is prompted through a series of steps by the computer 10. As indicated at 122, the operator needs to observe the patient and obtain certain information such as current blood pressure and current heart rate. Then at 124, the operator uses the computer 10 to access a patient profile database indicated at 126. Once the database is accessed, the operator then uses the computer 10 to update the database to incorporate the information from the operator's current observations regarding the patient.

Figure 6:
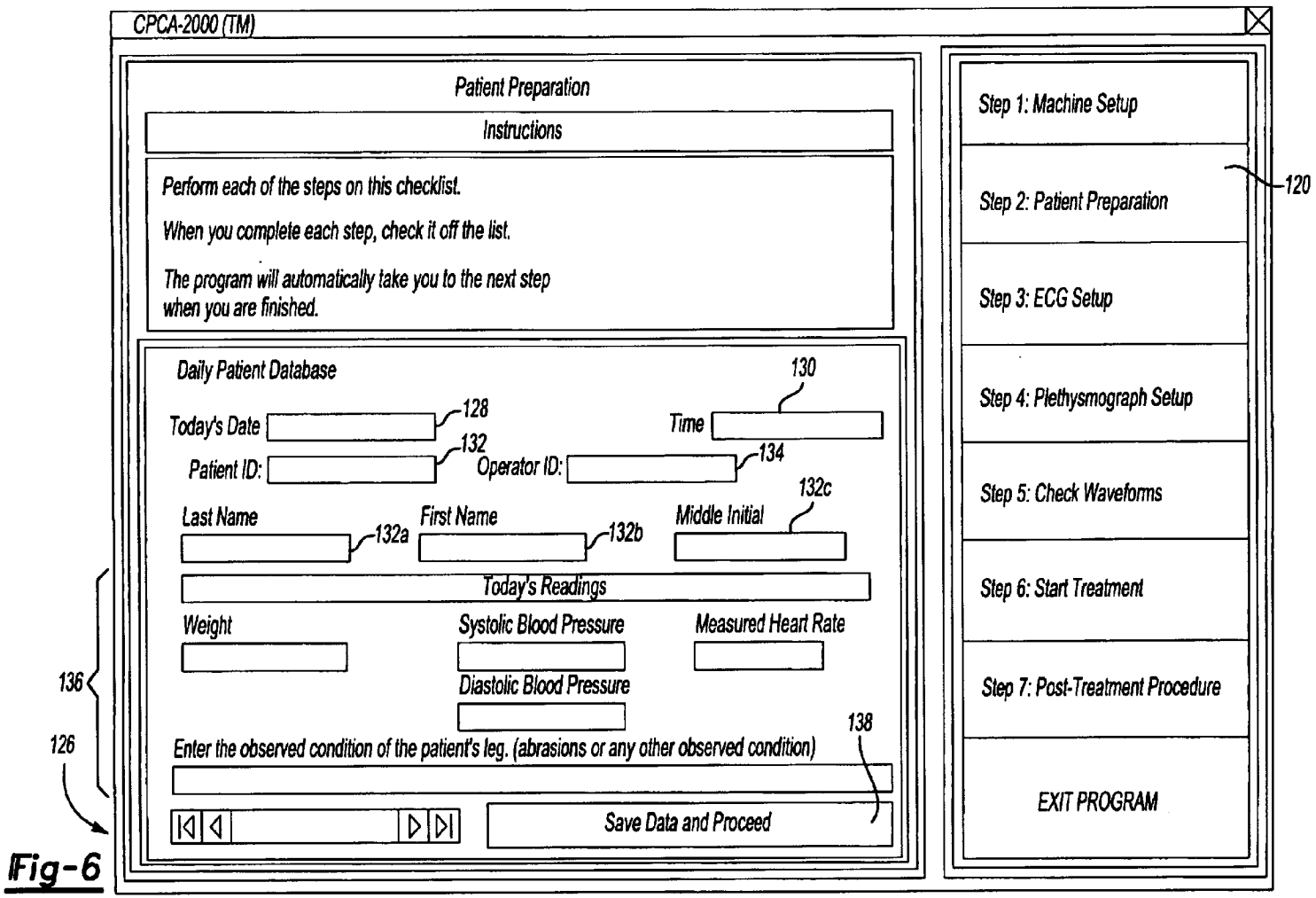
FIG. 6 illustrates an example computer display designed according to this invention.

FIG. 6 shows one example of a computer screen display indicating the preferred portions of the patient database 126 that should be completed prior to beginning a counterpulsation therapy session. The patient profile database designed according to this invention preferably includes historical record information such as the date 128 and time 130 that each session has been administered. Patient identification information such as a patient ID 132, the last name 132A, the first name 132B and middle initial 132C allow the database to track historical records for each patient. The operator's identification appears at 134. The observations regarding the patient's physical condition are entered at 136 including such factors as patient weight, blood pressure and heart rate. Further, the condition of the portions of the patient's body about which the treatment cuffs will be placed (i.e., the patient's legs) should also be entered into the database. Once all of the necessary information has been entered, the operator can then proceed onto the next step by saving the new data into the database 126 at 138.

As illustrated in FIG. 6, a touch screen system is useful and provides an efficient way of guiding an operator through the initial procedures required before beginning a counterpulsation therapy session. In the most preferred embodiment, the program module within the computer 10 requires an operator to follow a specific sequence of steps (such as verifying that the equipment has been set up followed by entering all of the necessary information into the patient profile database) before the computer 10 will permit the therapy system to be utilized. In the most preferred embodiment, the operator of the system is not permitted to proceed to a subsequent step or procedure until a current step or procedure is completed and that completion is verified by the computer 10.

Returning to FIG. 5, the next step preferably is to place the patient into an appropriate position and place the treatment cuffs 22, 24 and 26 on the selected body portions of the patient at 140. Once the treatment cuffs are appropriately positioned on the patient and that information is entered into the computer 10, the operator then is prompted to set up any external devices that are necessary to complete the treatment.

In the preferred embodiment, the counterpulsation therapy is carried out by timing the inflation and deflation of the treatment cuffs with certain characteristics of the patient's EKG signal and the plethysmographic blood pressure wave. Therefore, a conventional EKG 100 and a conventional pulse oximetry measurement system 102 must be appropriately set up so that the necessary signals can be obtained and communicated to the computer 10. The program module within the computer 10 preferably recognizes when a valid signal from an EKG and a plethysmograph are provided, which validates that the external devices are appropriately in position and operational.

At the point the preconditions are satisfied and the operator has authorized treatment, the computer 10 will proceed with administering the counterpulsation therapy.

Returning to FIGS. 3A and 3B, a series of operational steps are schematically illustrated. Once the computer 10 begins the treatment cycle, the first step 150 preferably is to establish baseline conditions such that valves 70, 72, 74, 76, 82, 84, 58 and 60 are closed, and cause the system to pause for a preselected period of time that preferably is less than 100 milliseconds. If step one is successfully completed then step two is performed.

Step two 152 preferably includes evacuating the cuffs 22, 24 and 26 to vacuum, which includes opening valves 76, 82 and 84. Valves 70, 72 and 74 remain closed and valves 58 and 60 are also closed. Once step 2 is successfully completed the cuffs are then vented to atmosphere as a third step 154. In this step, the valves 86, 88 and 90 are opened so that air or vacuum remaining within the cuffs 22, 24, and 26 is vented to atmosphere through the noise filter 40B.

The next, fourth, step 156 preferably provides a delay between venting the cuffs to atmosphere and the beginning of the sequential inflation of the cuffs. During this step, the valves 86, 88, and 90 are closed and the other valves remain in the condition they were in step 3.

Once step four is successfully completed, the fifth step 158 preferably is to inflate the first treatment cuff 22. Valve 76 is closed to maintain air within the cuff 22. Valve 70 is open to allow air from the third conduit 34 to be transferred into the cuff 22. A servomotor in the linear actuator 33 is energized to move the piston 32 through the housing 30 to move noncompressed air through the port 42 in the housing 30 and into the third conduit 34. During this procedure, valves 58 and 60 remain closed unless an undesirably high pressure is detected within the third conduit 34. If undesirably high pressure is achieved, the valve 58 or 60 is selectively opened (selection determined by direction of piston movement 32) to regulate the pressure within the third conduit 34.

Once the inflation of the first cuff 22 is successfully completed, the next step 160 is to inflate the cuff 24. As previously noted, the cuff 24 preferably is placed about the thighs of the patient's legs. During this step, the valve 72 is opened to allow the noncompressed air from the third conduit 34 to flow into and inflate the cuff 24. The valves 76 and 82 are kept closed so that the cuffs 22 and 24 remain inflated. As in the inflation of the cuff 22, the pressure transmitter 48 monitors the pressure within the third conduit 34 and, if necessary, the valve 58 or 60 selectively vents some of the noncompressed air into the atmosphere.

Once the cuff 24 is successfully inflated, the cuff 26 is next inflated. During this step 162, the valve 74 is opened while the remainder of the valves are closed so that air flows into and inflates the cuff 26. When all of the cuffs are successfully inflated, the system preferably holds the inflated condition for a preselected amount of time. During this hold cycle 164, valves 58 and 60 are open while the remainder of the valves are closed to maintain the desired inflation of the cuffs. During this time, air is allowed to pass from the filter 40A through conduits 38 and 39, through valves 58 and 60 and through conduits 29 and 31 into the cylinder which recharges and equalizes cylinder pressures in preparation for the next stroke sequence.

As indicated in FIGS. 3A and 3B, each of the steps must be successfully completed before the system will automatically proceed to the next step. In the event that the system is unable to verify that a step was successfully completed, a fault condition 166 is indicated and all of the valves except for valves are automatically deactivated. At the same time, the linear actuator 33 preferably returns to a home position (i.e., the piston 32 at position B) so that the piston 32 is ready for the beginning of a stroke through the housing 30.

After the cuffs have been sequentially and successfully inflated, then the system automatically and cyclically deflates and vents the cuffs and repeats the inflation procedure according to the timing requirements of a particular counterpulsation therapy regimen.

Given this description, those skilled in the medical therapy art will be able to determine the timing of the inflation and deflation of the cuffs and the coordination of that with the patient's natural blood flow in order to provide the desired therapy effect.

In the preferred embodiment, the patient database 126 is automatically updated to include information regarding the length of a particular therapy session, and to record variable data including heart rate, pulse oximetry readings, etc. The total duration of a therapy session may vary as a result of interruptions in the treatment procedure. For example, a patient may activate a stop switch 100A, to halt treatment at any time and for any reason. For example, a patient may feel that the cuffs are inflated too tightly causing discomfort. Therefore, it is useful to allow the patient to activate a switch 100A to stop the therapy session so that an adjustment to the amount of inflation can be made to provide more comfort to the patient.

Most preferably, the computer 10 communicates with the controller 20 so that the counterpulsation system cannot be operated unless and until the doctor or other health professional operating the system has completed the various steps of the initialization process. In other words, the initialization process is part of a program module within the computer 10 that acts as a triggering device for operating the counterpulsation system. This is a significant feature of this invention because it ensures proper operation of the system, which results in the desired therapy effect. Given this description, those skilled in the art will be able to develop the software necessary to achieve the desired results.

Once the system begins operating, a closed loop control is achieved because of the inter-communication between the computer 10 and the electronic controller 20. Although a separate computer and electronic controllers have been illustrated and discussed in this specification, those skilled in the art will appreciate that a single module or unit or a different number of microprocessors or controllers could be used depending on the needs of a particular situation.

Figure 7:
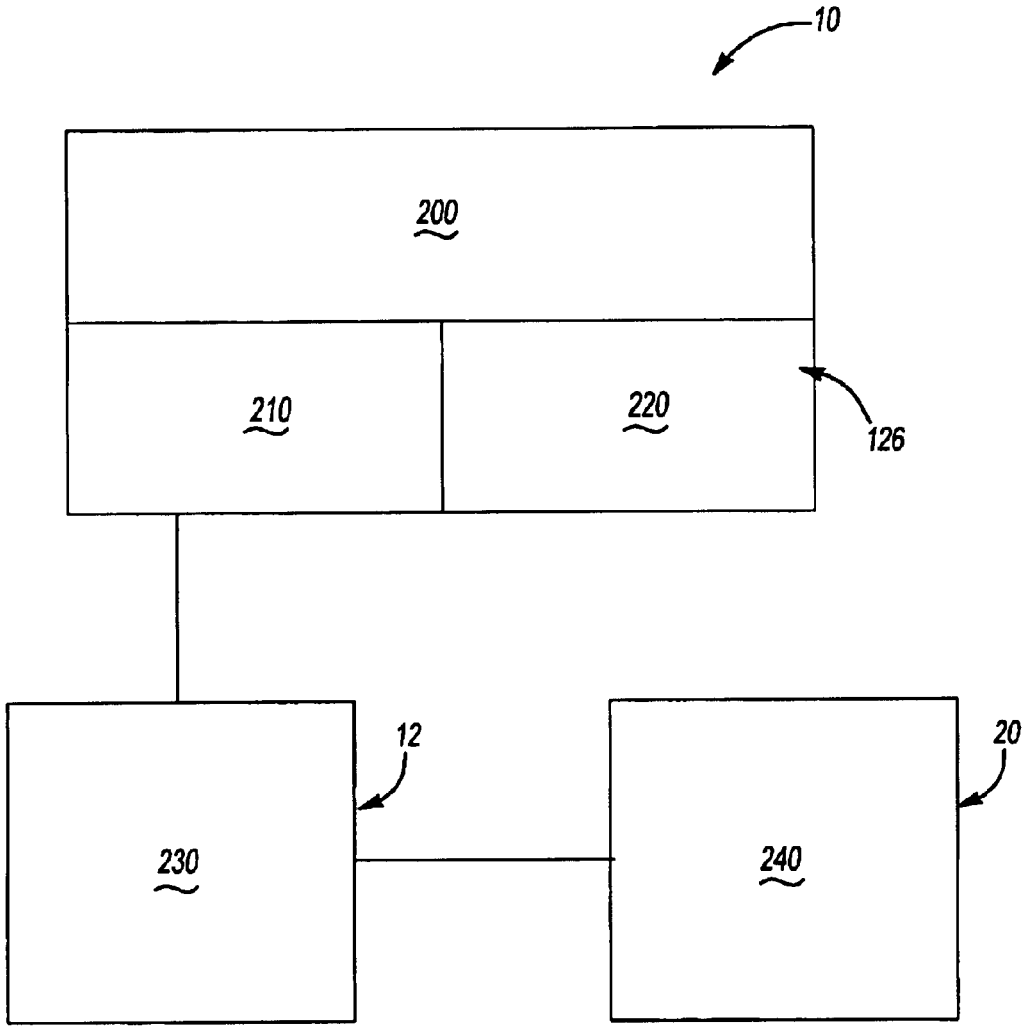
FIG. 7 schematically illustrates a computer software arrangement designed according to this invention.

One example embodiment is schematically illustrated in FIG. 7. The computer 10 includes a program having three modules or components. A main control module 200 includes the code necessary to operate the system. The main control module 200 includes, for example, the software necessary for recognizing the EKG and plethysmographic wave signals and for detecting fault conditions or patient requested stops. A second portion or module 210 of the program within the main computer 10 is preferably responsible for the operator interface portions of the system. This module 210 is responsible for prompting the user through the display screen on the computer to enter the desired information necessary to indicate that each of the initialization procedures has been successfully completed. This module 210 communicates with the module 200 so that the system controller can adequately verify that all necessary procedures have been completed prior to beginning a therapy session. A third module 220 preferably is provided, which is responsible for the patient profile database 126. The module 220 includes all of the historical data and the software necessary to maintain the data for each of the patients in a useable format. Although three modules are illustrated, those skilled in the art will recognize that a variety of configurations and combinations may accomplish the results provided by the three example modules.

As also schematically illustrated in FIG. 7, the controller 12 is programmed with a program module 230. This program module 230 interacts with the program module 200 so that the robot linear actuator 33 is energized to move the piston 32 according to the needs of the desired therapy regime. This module 230 preferably includes commercially available instructions for moving the linear actuator 33. The controller 20 is programmed with a program module 240, which is responsible for operating the various valves in the system so that the cuffs are inflated and deflated to achieve the desired therapeutic effect. The closed loop communication and automatic operation of the program modules 200 through 240 provides a significant advantage for operating a counterpulsation therapy system designed according to this invention. The closed loop control not only ensures adequate and accurate operation of the system but also automatically provides and updates a patient profile database that can be used to determine the effectiveness of a counterpulsation therapy regimen for an individual patient or selected study groups.

The above description is exemplary rather than limiting in nature. Variations and modifications to the described embodiment may become apparent to those skilled in the art that do not necessarily depart from the purview and spirit of this invention. The scope of legal protection given to this invention can only be determined by studying the following claims.

What is claimed is:

1. A method of controlling a counterpulsation therapy system that includes a computer that controls the operation of the system, comprising the steps of:

(A) defining a plurality of procedures to be performed by an operator of the system;

(B) prompting the operator, using the computer, to perform the plurality of procedures from step (A);

(C) verifying that each of the procedures is completed, using the computer; and (D) operating the counterpulsation therapy system only when the verification from step (C) is complete.

2. The method of claim 1, wherein step (A) includes assigning a preselected order in which the plurality of procedures must be performed.

3. The method of claim 2, wherein step (C) includes verifying that the procedures were completed in the preselected order.

4. The method of claim 1, wherein step (B) includes providing a computer screen display that visually indicates the procedures to be performed.

5. The method of claim 4, wherein step (B) includes providing a different computer screen display for each of the plurality of procedures and wherein each said display includes visible instructions that guide the operator through the procedure.

6. The method of claim 1, wherein step (C) includes requiring the operator to provide a predefined input to the computer that indicates that the procedures have been completed.

7. The method of claim 6, wherein step (C) includes requiring the operator to provide a separate predefined input to the computer that each indicate that a respective one of the procedures has been completed.

8. The method of claim 7, wherein step (A) includes assigning a preselected order in which the plurality of procedures must be performed and wherein steps (B) and (C) are performed in sequence for each of the procedures and wherein the method includes not permitting an operator to continue on from a current procedure to a subsequent procedure until the operator provides an indication that the current procedure is satisfactorily completed.

9. The method of claim 1, wherein at least one of the procedures from step (A) includes arranging and initiating an external device for monitoring a condition of the patient and wherein step (C) includes providing the computer with a signal from the external device verifying that the external device has been properly arranged and is operational.

10. The method of claim 1, wherein the procedures of step (A) include entering a patient identifier;

entering current patient status including one or more of the group consisting of current blood pressure, current heart rate, current body temperature, current weight, current condition of the skin on the portion of the body about which the cuff is placed;

arranging an electrocardiogram device such that the device provides an indication of the patient's heart beat to the computer; and arranging a plethysmograph device such that the device provides an indication of the patient's blood pressure to the computer.

11. The method of claim 10, wherein step (C) includes verifying that the procedures of step (A) are performed sequentially in the order listed in claim 10.

* * * * *